US006659445B2

(12) United States Patent
Boss

(10) Patent No.: US 6,659,445 B2
(45) Date of Patent: Dec. 9, 2003

(54) ARRANGEMENT FOR FORMING A THIRD STREAM OF FIRST AND SECOND STREAMS COMPRISED OF PRINTED PRODUCTS

(75) Inventor: Heinz Boss, Strengelbach (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 10/188,581

(22) Filed: Jul. 3, 2002

(65) Prior Publication Data

US 2003/0011120 A1 Jan. 16, 2003

(30) Foreign Application Priority Data

Jul. 16, 2001 (EP) ..... 01810707

(51) Int. Cl.[7] ..... B65H 5/22

(52) U.S. Cl. ..... 271/9.13; 271/9.12; 271/184; 271/202; 271/270; 271/225

(58) Field of Search ..... 271/9.13, 9.12, 271/225, 69, 202, 270, 184; 270/58.23, 56, 52.09; 198/418.6, 418.9, 443, 447, 426, 433, 644, 601

(56) References Cited

U.S. PATENT DOCUMENTS

| | | | | | |
|---|---|---|---|---|---|
| 3,079,150 | A | * | 2/1963 | Lopez | 271/69 |
| 3,547,024 | A | * | 12/1970 | Lopez | 271/202 |
| 3,946,626 | A | * | 3/1976 | Koppa | 83/105 |
| 4,273,319 | A | * | 6/1981 | Stocker | 270/21.1 |
| 4,674,375 | A | | 6/1987 | Golicz | |
| 4,795,143 | A | * | 1/1989 | Tsai | 270/52.09 |
| 4,974,719 | A | * | 12/1990 | Chenevard | 198/433 |
| 5,727,781 | A | * | 3/1998 | Muller | 270/58.23 |
| 5,887,503 | A | | 3/1999 | Kataigi et al. | |
| 6,158,735 | A | * | 12/2000 | Cote et al. | 271/302 |
| 6,189,827 | B1 | | 2/2001 | Vollenweider | |
| 6,378,861 | B1 | * | 4/2002 | Middelberg et al. | 271/225 |
| 6,402,136 | B1 | * | 6/2002 | Lamothe | 271/185 |
| 6,443,447 | B1 | * | 9/2002 | Ifkovits et al. | 271/225 |

FOREIGN PATENT DOCUMENTS

| | | |
|---|---|---|
| DE | 3938285 | 6/1990 |
| DE | 298 19 145 U1 | 6/1999 |
| EP | 0292458 | 11/1988 |
| GB | 1358655 | 7/1974 |

* cited by examiner

*Primary Examiner*—Patrick Mackey
(74) *Attorney, Agent, or Firm*—Friedrich Kueffner

(57) ABSTRACT

An arrangement for forming a third stream of at least one first and one second stream of identical printed products has a first transport device synchronously conveying in a first conveying direction the first and second streams adjacent to one another. A second transport device is arranged downstream of the first transport device and has a second conveying direction substantially transverse to the first conveying direction of the first transport device. The first and second transport devices form steps transporting the printed products in a cascade fashion and combining the first and second streams to a common third stream.

12 Claims, 3 Drawing Sheets

3
S1
4
S2
1
2a
W3
2b
2

A
3
$v_2$
B
$v_3$
4
25

3'
4'
L2
$v_2$
A
$v_3$
B $v_2$
B'
$v_3$
4'
3
4

L3
L1
$v_2$
$v_3$ $v_2$
L4
$v_3$ $v_2$
$v_3$ $v_2$
$v_3$
3'
4'
3
D

ARRANGEMENT FOR FORMING A THIRD STREAM OF FIRST AND SECOND STREAMS COMPRISED OF PRINTED PRODUCTS

BACKGROUND OF THE INVENTION

1. Field of the Invention

The invention relates to an arrangement forming a third stream out of a first stream and a second stream of printed products.

2. Description of the Related Art

Such arrangements are known for processing so-called double-up products. Such double-up products are formed, for example, by means of a gather-stitcher and, in general, are also stitched by it. In a cutting machine, also referred to as a trimmer, these double-up products are trimmed with the spine or back leading. In this way, out of each double-up product two printed products are produced which are trimmed on three sides. Downstream of the cutting machine, the trimmed printed products are conveyed in two synchronously moving streams. For further processing of the printed products, these two streams are supplied to a processing machine, respectively. These machines are, in particular, stackers, for forming packets, or winding devices. In the stackers, the printed products are stacked atop one another as is known in the art. By means of the winding devices, the streams are converted to imbricated streams and these are wound to rolls by means of winding straps. These rolls can be stored and unwound at a desired point in time.

SUMMARY OF THE INVENTION

It is an object of the present invention to provide an arrangement of the aforementioned kind which simplifies processing of double streams and, in particular, processing of double-up products. Despite of this, a comparatively high output is to be provided.

In accordance with the present invention, this is achieved in that a second transport device is arranged downstream of the first transport device, which is conveying-effective in a direction substantially transverse to the conveying direction of the first transport device, and in that the two transport devices provide steps where the printed products can be conveyed in a cascade fashion and with which the first and second streams are combined to a common third stream on the second transport device.

According to the arrangement of the present invention, the two streams are combined to a common stream. This is achieved by means of steps where the printed products are conveyed in a cascade-like fashion. The technical term for such steps or cascade-like conveying paths is "bumpturn". They are generally known in the printed products industry and are functionally reliable as well as controllable without great configurational expenditure. Since only one stream must be further processed accordingly, it is only necessary to provide a single further processing machine to which this stream is then supplied. In this way, the processing sequence can be simplified and costs can be saved. For example, the printed products can be combined in a single stacker to packets or can be rolled onto a single winding roller.

When, according to a further embodiment of the invention, the arrangement is configured such that the common third stream is an imbricated stream, it can be wound to a roll. The output of the device according to the invention is at least comparable to that of known devices of this kind. For products of a format DIN A5 (German industrial standard), it is easily possible to process two times 13,000 copies per hour.

Further advantageous features can be taken form the dependent claims, the following description, and the drawing.

DESCRIPTION OF THE PREFERRED EMBODIMENTS

Figure 2:
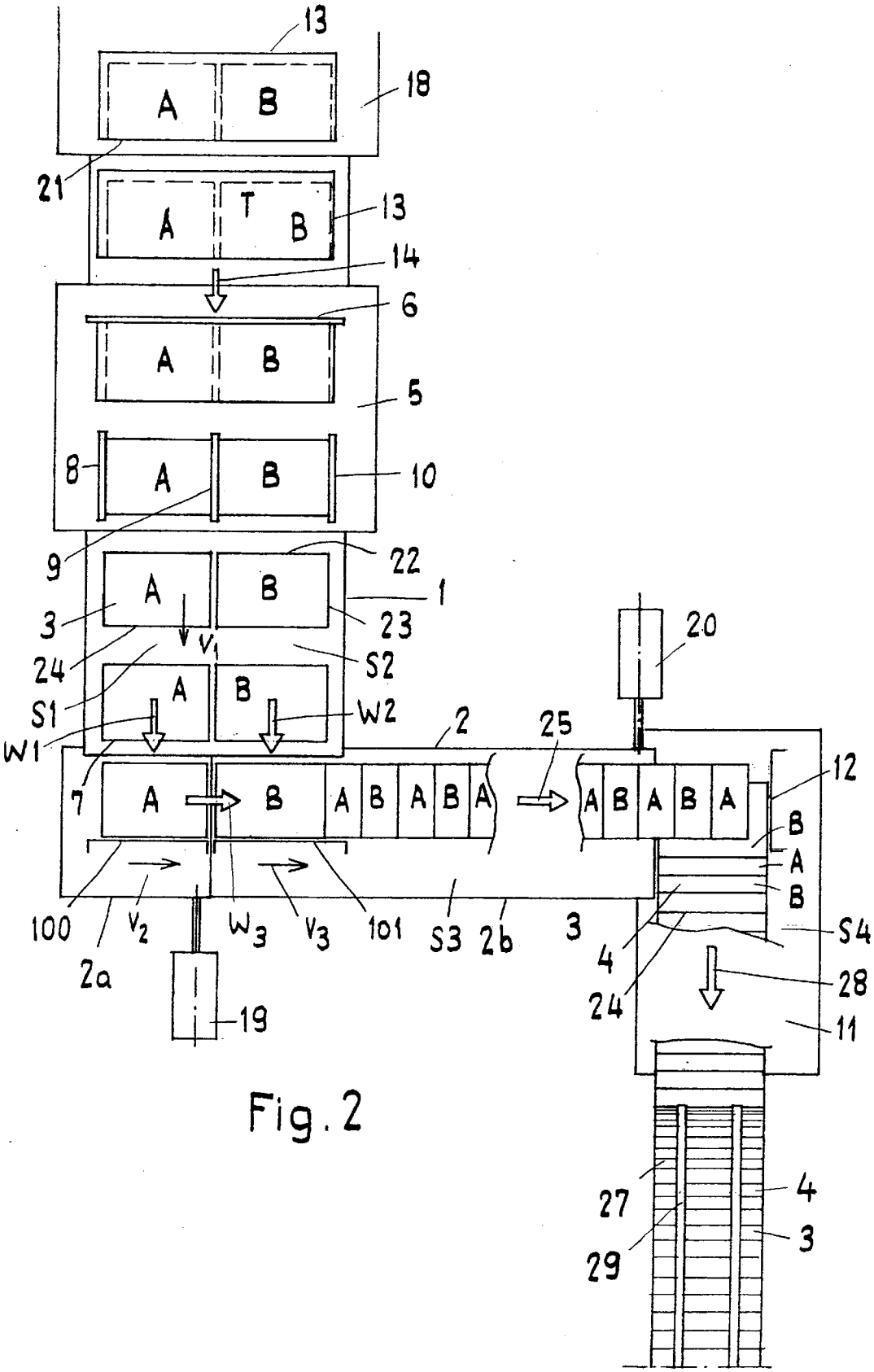
FIG. 2 shows a plan view onto the arrangement according to the invention.

According to FIG. 2, the arrangement has substantially a first transport device 1, a second transport device 2, a gather-stitcher 18 as well as a cutting machine 5. In the gather-stitcher 18, which is only schematically indicated and is of a conventional design, the so-called double-up products 13 are processed and their spine 21 is preferably stitched by a conventional stitcher (not illustrated). The double-up products 13 are printed with information A and B for two printed products 3 and 4. A and B are conventionally identical and symmetrical.

The double-up products 13 formed in the gather-stitcher 18 are then transferred to the first transport device 1 on which they are transported in the direction of arrow 14 with their spine 21 leading and are supplied to a cutting device 5, also referred to as trimmer. This cutting device 5 has a front cutting device 6 and two lateral knives 8, 10 as well as a central cutting knife 9; it also has stops which are not illustrated here. The double-up products 13 are trimmed by the cutting device 5 at the sides and also parallel to the spine 21. By means of the central cutting knife 9 the double-up products 13 are separated along the dashed line T. After having passed through the cutting device 5, printed products 3 and 4, for example, brochures, magazines and the like, are present which are trimmed on three sides and which are gather-stitched. The printed products 3 and 4 are transported with their spine 24 leading. The cut front 22 is thus in the trailing position and the lateral cuts 23 extend parallel to the conveying direction according to arrow 14.

The printed products 3 form a first stream S1 and the printed products 4 form a second stream S2. Both streams S1, S2 move preferably synchronously with one another and, as illustrated, the printed products 3 and 4 are spaced in the conveying direction from one another, respectively.

Figure 1:
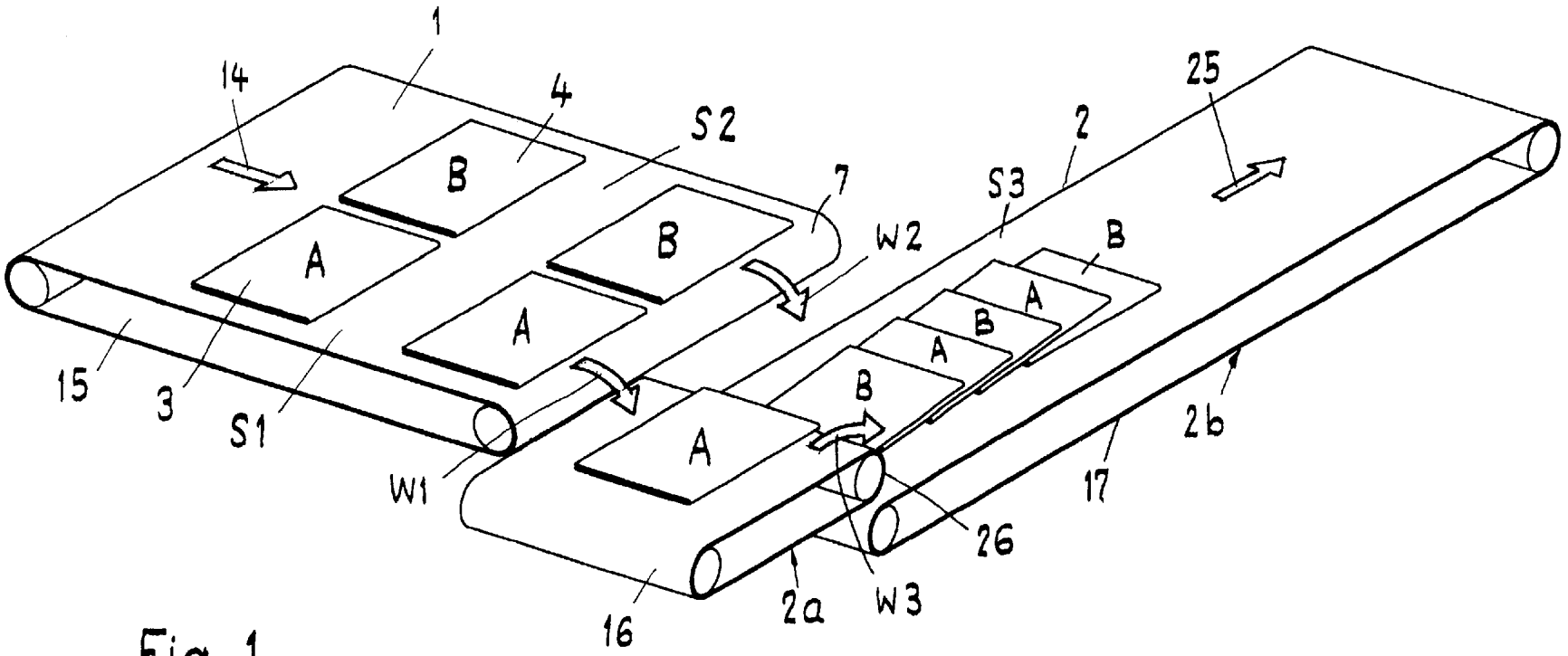
FIG. 1 shows schematically a perspective partial view of the arrangement according to the invention.

The transport device 1 comprises a transport member 15, shown in FIG. 1, downstream of the cutting device 5, wherein the transport member 15 can be, for example, an endless belt. The transport of the two streams ends at a forward edge 7.

Downstream of the edge 7, the second transport device 2 is arranged transverse to the conveying direction according to arrow 14. It has a conveying direction which, according to arrow 25, is substantially transverse to the conveying direction 14 of the transport device 1. The transport device 2 comprises two conveying sections in the form of a first transport member 2*a* as well as a second transport member 2*b*. These transport members 2*a*, 2*b* are formed, for example, by a transport belt 16 and a transport belt 17. However, in principle, other transport members are also possible. The two transport members 2*a* and 2*b* are driven by a separate controlled drive 19 and 20, respectively. As illustrated in FIG. 1, the first transport member 2*a* is positioned slightly underneath and in front of the edge 7 and the second transport member 2*b* is positioned underneath a forward edge 26 of the first transport member 2*a*. The transition of the first transport device 1 to the second transport device 2 thus forms a first step, and a second step is formed between the transport member 2*a* and the transport member 2*b*. Since the two transport members 2*a* and 2*b* are vertically staggered or displaced relative to one another, a double step according to W1 plus W3 is formed for the stream S1. The stream S2 is guided via the step W2, which corresponds to the sum of the drop heights of the steps W1 and W3, onto the transport member 2*b*. The printed products 3 of the stream S1, coming from the first transport member 2*a*, also reach the second transport member 2*b* after passing step W1 and the additional step W3.

The conveying speed of the streams S1, S2 is identified with arrow V1, the speed of the transport member 2*a* with V2, and the speed of the imbricated stream S3 with V3. On the first transport member 2*a* the printed products 3 are changed from the speed V1 to the speed V2. The printed products 4 are changed from the speed V1 to the speed V3 of the transport member 2*b*. The speed V2 acts in the same direction as the speed V3 but its absolute value is substantially higher, preferably approximately twice as high.

The steps W1 to W3 are configured such that the two streams S1 and S2 are combined to a common stream S3. The stream S3 is preferably, but not mandatorily, an imbricated stream. For generating a substantially aligned conveying stream on the conveying member 2*b*, adjustable stops 100, 101 are arranged thereon as on the upstream conveying member 2*a*, wherein the stops are preferably adjustable with respect to different sizes of the printed products.

In the following, with the aid of FIGS. 3*a* to 3*h*, the formation of a common stream S3 will be explained.

Figures 3A, 3B, 3C, 3D, 3E, 3F, 3G, 3H:
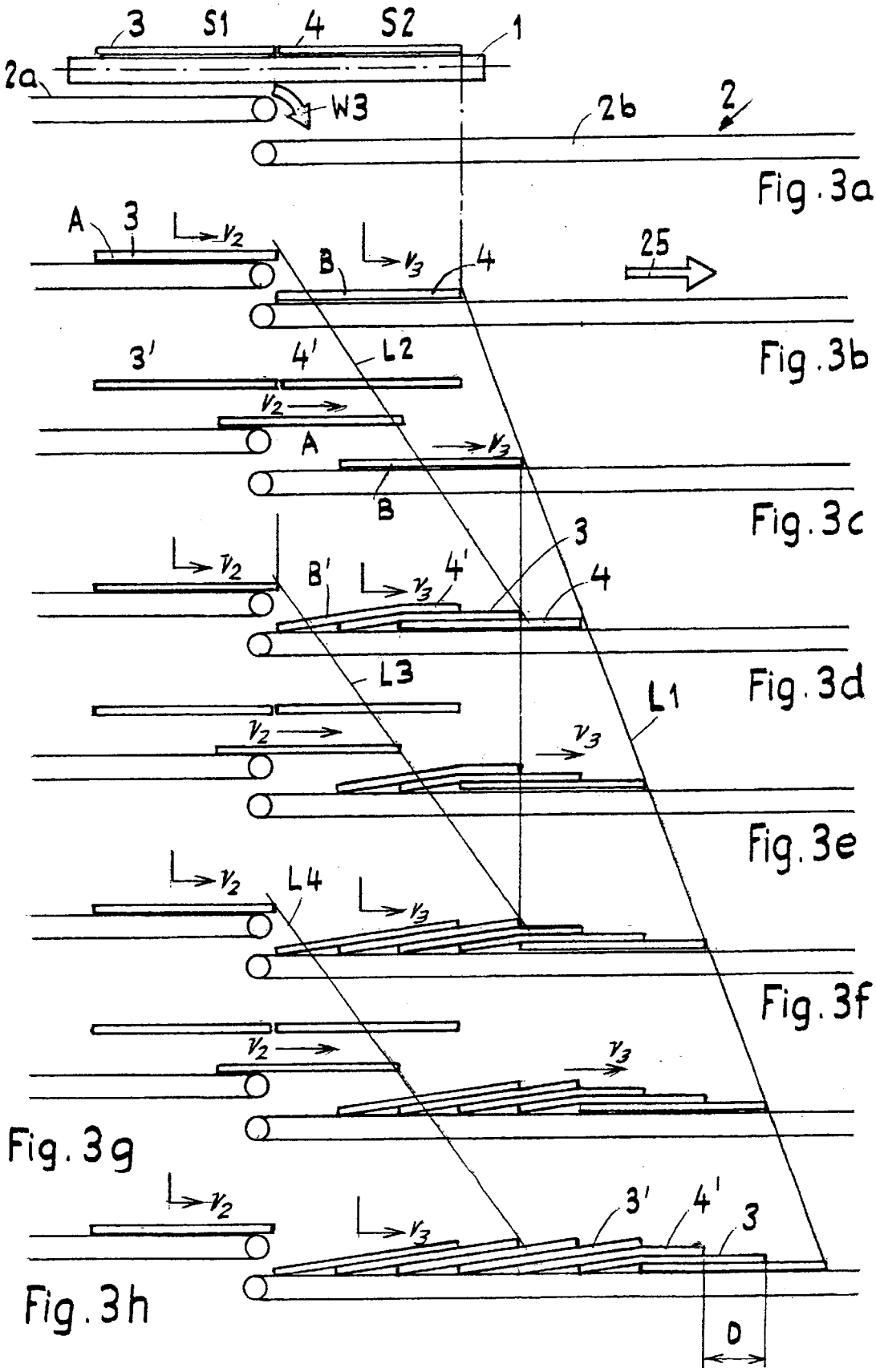
FIG. 3 shows schematically how a common stream is formed of two streams.

FIG. 3*a* shows schematically the first transport device 1 and the two transport members 2*a* and 2*b* of the second transport device 2. On the second transport device 2 no printed products are present yet. On the first transport device 1 a first stream S1 with printed products 3 and a second stream S2 with printed products 4 are conveyed, as explained above. When a printed product 3 as well as a printed product 4 reach the edge 7 (FIG. 2), they reach via the steps W1 and W2, respectively, the second transport device 2. The printed product 3 reaches the first transport member 2*a* and the printed product 4 the transport member 2*b*. FIG. 3*b* shows the situation where the printed product 3 is positioned on the first transport member 2*a* and the printed product 4 on the second transport member 2*b*. The printed product 3 has the speed V2 and the printed product 4 has been changed to the speed V3. The speed V2 is significantly higher with regard to its absolute value, for example, twice as high as the speed V3. Via the step W3 the printed product 3 is conveyed onto the second transport member 2*b*. As a result of the higher speed V2 the printed product 3 is pushed on top of the printed product 4 and is positioned thereon at an imbricated spacing D, illustrated in FIG. 3*h*.

At the same time, the following printed products 3' and 4' arrive at the edge 7 and reach via steps W1 and W2, respectively, the second transport device 2. The printed product 4' is placed with an imbricated spacing D onto the printed product 3 and the printed product 3' is placed onto the printed product 4', also at the imbricated spacing D. In this way, on the transport member 2*b* a third stream S3 is formed which is an imbricated flow with the imbricated spacing D. The process is repeated for each of the product pairs arriving at the edge 7. The printed products deposited onto the transport member 2*b* are, of course, continuously conveyed at the speed V3 in the transport direction of the arrow 25. The lines L1 to L4 in FIGS. 3*b* to 3*h* connect the edges of the same product and serve only for understanding the processing sequence.

As has been explained above, the two transport members 2*a* and 2*b* are driven independent from one another in the same transport direction by controllable drives 19 and 20, respectively. By adjusting the speed V2 and V3, an optimal imbricated flow S3 can be adjusted.

Downstream of the transport member 2*b*, according to FIG. 2, a third transport device 11 is arranged which has, for example, also an endless transport belt and a stop 12 against which the products of the third stream S3 are conveyed. This stop 12 effects turning of the stream by 90 degrees wherein the arriving imbricated stream S3 is transformed into a further imbricated flow S4. In this imbricated flow S4 the spines 24 are again arranged in a leading position with respect to the conveying direction as in the first transport device 1. The conveying direction of S4 is illustrated in FIG. 2 by the arrow 28 and is thus substantially parallel to the conveying direction of the first transport device 1.

The imbricated flow S4 is, for example, supplied to a winding device 27, indicated only schematically in FIG. 2, where the printed products 3 and 4 are wound in an imbricated stream and secured by straps 29. The printed products 3 and 4 in the streams S3 or S4 can advantageously be provided with addresses by means of an addressing device (not illustrated). Advantageous in this connection is that the printed products 3 and 4 have a defined sequence. However, the printed products 3 and 4 of the stream S4 can also be supplied to a stacker, not illustrated, or a different device for forming packets. The arrangement according to the invention has the additional advantage that top quality packets and standard packets can be formed in any suitable sequence. The stream S4 is preferably an imbricated stream. Conceivable is also a configuration in which the stream S4 is a product stream in which the sequential printed products 3 and 4 do not overlap. Basically, it is also possible to already supply the stream S3 to a further processing device, for example, a stacker or a winding device. The stream S3 can, in principle, also be a stream in which the sequential printed products 3 and 4 do not overlap.

While specific embodiments of the invention have been shown and described in detail to illustrate the inventive principles, it will be understood that the invention may be embodied otherwise without departing from such principles.

What is claimed is:

1. An arrangement for forming a third stream of at least one first and one second stream of identical printed products, the arrangement comprising:

a first transport device configured to synchronously convey in a first conveying direction the first and second streams adjacent to one another;

a second transport device downstream of the first transport device and having a second conveying direction substantially transverse to the first conveying direction of the first transport device;

wherein the first and second transport devices form steps configured to transport the printed products in a cascade fashion and configured to combine the first and second streams to a common third stream, wherein the second transport device has a first conveying section and a second conveying section, the first and second conveying sections configured to convey in a same transport direction, wherein the first conveying section is arranged upstream of the second conveying section, wherein a first one of the steps is formed between the first conveying section and the first transport device and a second one of the steps is formed between the second conveying section and the first transport device, wherein the first step has a first height and the second step has a second height, wherein the first height is smaller than the second height.

2. The arrangement according to claim 1, wherein the second transport device has at least two conveying sections formed by transport members, wherein a first one of the transport members is correlated with the first stream and a second one of the transport members is correlated with the second stream, wherein the first transport member has a first transport direction and the second transport member has a second transport direction, wherein the first and second transport directions are identical.

3. The arrangement according to claim 2, wherein a first one of the steps between the first transport device and the second transport device has a height different from a height of a second one of the steps between the first transport device and the second transport device.

4. The arrangement according to claim 3, wherein the first stream is supplied via the first step to the first transport member and the second stream via the second step to the second transport member.

5. The arrangement according to claim 2, wherein the transport members have stops adjustable depending on a size of the printed products and extending parallel to the first and second transport directions.

6. The arrangement according to claim 5, wherein the stops are aligned with one another.

7. The arrangement according to claim 4, wherein the printed products of the first stream are accelerated on the first transport member in a direction transverse to the conveying direction of the first transport device to a first speed and wherein the printed products of the second stream are accelerated to a second speed on the second transport member in a direction transverse to the conveying direction of the first transport device, wherein the second speed has an absolute value smaller than the first speed.

8. The arrangement according to claim 7, wherein the first speed is approximately twice as high as the second speed.

9. The arrangement according to one of the claim 1, wherein the first and second streams transported on the first transport device are produced by a cutting machine for cutting double-up products to individual products.

10. The arrangement according to claim 1, wherein, at least on the first transport device, the printed products are conveyed in a position in which a spine of the printed products is leading.

11. The arrangement according to claim 1, further comprising a third transport device arranged downstream of the second transport device, wherein the third transport device has an abutment, wherein the abutment is configured to deflect the common stream impacting on the abutment by approximately 90 degrees.

12. The arrangement according to claim 11, wherein the common stream is in the form of an imbricated stream upstream and downstream of the abutment.

* * * * *